US005906504A

United States Patent [19]

Igarashi et al.

[11] Patent Number: 5,906,504

[45] Date of Patent: May 25, 1999

[54] ELECTRICAL CONNECTOR FOR CONNECTING FPC TO PRINTED CIRCUIT WITH MEANS FOR FIXEDLY CONNECTING FPC TO THE CONNECTOR WITHOUT REMOVAL OF FPC FROM THE CONNECTOR

[75] Inventors: Isao Igarashi; Mamoru Suzuki, both of Tokyo, Japan

[73] Assignee: Japan Aviation Electronic Industry, Ltd., Japan

[21] Appl. No.: 08/833,219

[22] Filed: Apr. 14, 1997

[30] Foreign Application Priority Data

Apr. 15, 1996 [JP] Japan ..... 8-092255

[51] Int. Cl.[6] ..... H01R 23/66

[52] U.S. Cl. ..... 439/495

[58] Field of Search ..... 439/492, 494–499, 439/67, 83, 260

[56] References Cited

U.S. PATENT DOCUMENTS

| | | | |
|---|---|---|---|
| 4,921,442 | 5/1990 | Puerner | 439/499 |
| 5,695,359 | 12/1997 | Fujikura | 439/495 |
| 5,695,360 | 12/1997 | Seto et al. | 439/495 |

FOREIGN PATENT DOCUMENTS 5-6759 1/1993 Japan .

*Primary Examiner*—Khiem Nguyen

*Attorney, Agent, or Firm*—Laff, Whitesel Conte & Saret, Ltd.

[57] ABSTRACT

A connecting member for electrically connecting a flat cable with a connector unit mounted on an electric apparatus, wherein an end portion of the flat cable has a projection projecting therefrom and exposed conductor portions of conductor lines in the cable, while the connecting member has a plurality of contacts supported in an insulator for electrically connecting with the connector and for electrically connecting with corresponding ones of the exposed portions. The insulator has a cavity into which a slider of insulator material is inserted together with the flat cable when the connecting member is connected at the end of the cable. The slider has a receiving surface for receiving the flat cable and a stop for engaging the projection of the flat cable to prevent the flat cable from removal of the receiving surface. Each of contacts has a contact portion and an engaging portion projecting in the cavity towards each other. The contact portion comes into contact with corresponding one of the exposed conductor portions, and the engaging portion engages with a corresponding one of recesses formed in the slider to prevent the slider and the cable from removal out of the cavity.

21 Claims, 11 Drawing Sheets

ELECTRICAL CONNECTOR FOR CONNECTING FPC TO PRINTED CIRCUIT WITH MEANS FOR FIXEDLY CONNECTING FPC TO THE CONNECTOR WITHOUT REMOVAL OF FPC FROM THE CONNECTOR

BACKGROUND OF THE INVENTION

This invention relates to an electrical connector device, and in particular, to an connecting member for connecting a wiring member such as a flexible printed circuit (FPC), a flexible flat cable (FFC) and others to an electrical device such as a printed circuit board.

A known connecting member of the type is described, for example, in Japanese Unexamined Utility Model Publication, JP-U-5-6759.

In the JP-U, an electrical connector and a slide insulator are disclosed as a connecting member for connecting a wiring member such as FPC, FFC, or others to a printed circuit board. FPC and FFC will be collectively referred to as a flat cable, hereinafter. The electrical connector is mounted on a printed circuit board. An end of FPC is inserted together with a slide insulator into the electrical connector and is mechanically and electrically connected to the electrical connector. In the case, the slider insulator is used as the connecting member for connecting the FPC to the electrical connector mounted on the printed circuit.

The electrical connector comprises a base insulator, a holddown for fixedly holding the base insulator mounted on the printed circuit board, a slide insulator combined with the base insulator, and a plurality of conductive contact fitted in the base insulator to be brought into contact with the FPC.

The FPC is inserted together with the slide insulator into an insert cavity formed in the base insulator. At this time, conductive patterns of the FPC are faced to contacting portions of the contacts in one-to-one correspondence. Simultaneously, the FPC is pressed by a plate portion of the slide insulator. Thus, the conductive patterns are brought into contact with contacting points of the contacting portions in one-to-one correspondence.

With the above-mentioned structure, the FPC is put into contact with the contacting points under a pressing force of the plate portion to be simply clamped between the plate portion and the contacting portions having elasticity. Therefore, the FPC can be unfortunately easily released from the electrical connector if it is pulled in a releasing direction.

In view of the above, it is proposed to design the electrical connector such that the contacting portions of the contacts have strong elastic force sufficient to obtain increased contacting force. On the other hand, the electrical connector is generally desired to have a compact structure such that the contacts are fitted in the base insulator of a small size with a very high density. Therefore, each of the contacts comprises a thin plate having a reduced thickness and a small size and can not have such strong elastic force as desired.

In the electrical connector, it is also desired to easily connect and disconnect the FPC to the connector mounted on the printed circuit.

SUMMARY OF THE INVENTION

It is therefore a general object of this invention to provide a connecting member for connecting a wiring member to an electrical connector mounted onto a printed circuit which allows easy connection of the wiring member to the electrical connector but inhibits easy release of the wiring member from the electrical connector against vibration or any other external force.

It is another object of this invention to provide a connecting member which is fixedly connected to an end of the wiring member and is impossible to release the connection once they are connected together.

According to this invention, there is provided a combination of a conductor member and a connecting member for electrically and mechanically connecting the conductor member to an electrical connector. The conductor member comprises an elastic insulator element having an end portion and projection means projecting from the end portion, and at least one conductor line supported by the insulator element and having an exposed portion exposed from the insulator element at the end portion. The connecting member comprises at least one contact element of elastic metal to be connected with the exposed portion of the at least one conductor line and to be electrically connected with the electrical connector, the contact element having a contact portion; an insulator body to be removably and mechanically connected to the electrical connector, the insulator body having at least one contact room in which the at least one contact element is fixedly accommodated, the insulator body further having a hole continuing to the contact room, in which hole the contact portion projects; a slider of insulator material having a receiving surface for receiving the conductor member and engaging means formed in the receiving surface for engaging with the projection means to prevent the conductor member from moving in a direction opposite to the end portion when the conductor member is received on the receiving surface, the slider being slidable into the hole together with the conductor member whereby the exposed portion comes into contact with the contact portion; and locking means for locking the slider in the hole when the slider inserted into the hole together with the conductor member being received on the receiving surface while the projection means engaging with the engaging means, whereby the conductor member and the slider being prevented from being removed out of the hole in the insulator body.

According to another aspect of this invention, there is provided an electrical connector device for electrically connecting a flat wiring member with an electrical device, comprising a pair of first and second connector units mating to each other, the first and second connector units mating to each other, the first connector unit being mounted on and electrically connected to the electrical device having terminals, the second connector unit being fixedly connected to an end portion of the flat wiring member. The flat wiring member comprises a plurality of strip-like conductor lines spaced from each other, an insulator element of first and second insulator sheets laminated together and holding the conductor lines therebetween, the first flexible insulator sheet being short of an end at the end portion to provide exposed portions of the conductor lines which portions are exposed from the first insulator sheet; and projection means projecting from the insulator means at the end portion. The first connector unit comprises a first insulator body having a plurality of first contact holes, and a plurality of first contact elements fixedly held in the first contact holes, each of the first contact elements having a terminal portion to be connected to corresponding ones of the terminals of the electrical device when the first connector unit is mounted onto the electrical device. The second connector unit comprises a plurality of second contact elements of elastic metal to be brought into contact with corresponding ones of the first contact elements of the first electrical connector unit, the second contact elements having a plurality of contact portions to be connected with corresponding ones of the exposed portions of the conductor lines; a second insulator body to be removably and mechanically connected to the first insulator body, the second insulator body having a plurality of contact rooms in which the second contact elements are fixedly accommodated, respectively, the second insulator body further having a hole continuing to the contact rooms, in which hole the contact portions project; a slider of insulator material having a receiving surface for receiving the flat wiring member and engaging means formed on the receiving surface for engaging with the projection means to prevent the flat wiring member from moving in a direction opposite to the end portion when the flat wiring member is received on the receiving surface, the slider being slidable into the hole together with the flat wiring member whereby the exposed portions come into contact with the contact portions, respectively; and locking means for locking the slider in the hole when the slider is inserted into the hole together with the flat wiring member being received on the receiving surface while the projection means engaging with the engaging means, whereby the flat wiring member and the slider being prevented from being removed out of the hole in the second insulator body.

According to another aspect of this invention, there is provided an electric apparatus which has a printed circuit board, a flat cable, and the first and the second connector units for connecting between the printed circuit board and the flat cable.

DESCRIPTION OF THE PREFERRED EMBODIMENTS

In order to facilitate an understanding of this invention, description will at first be made about a conventional electrical connector.

Figure 1:
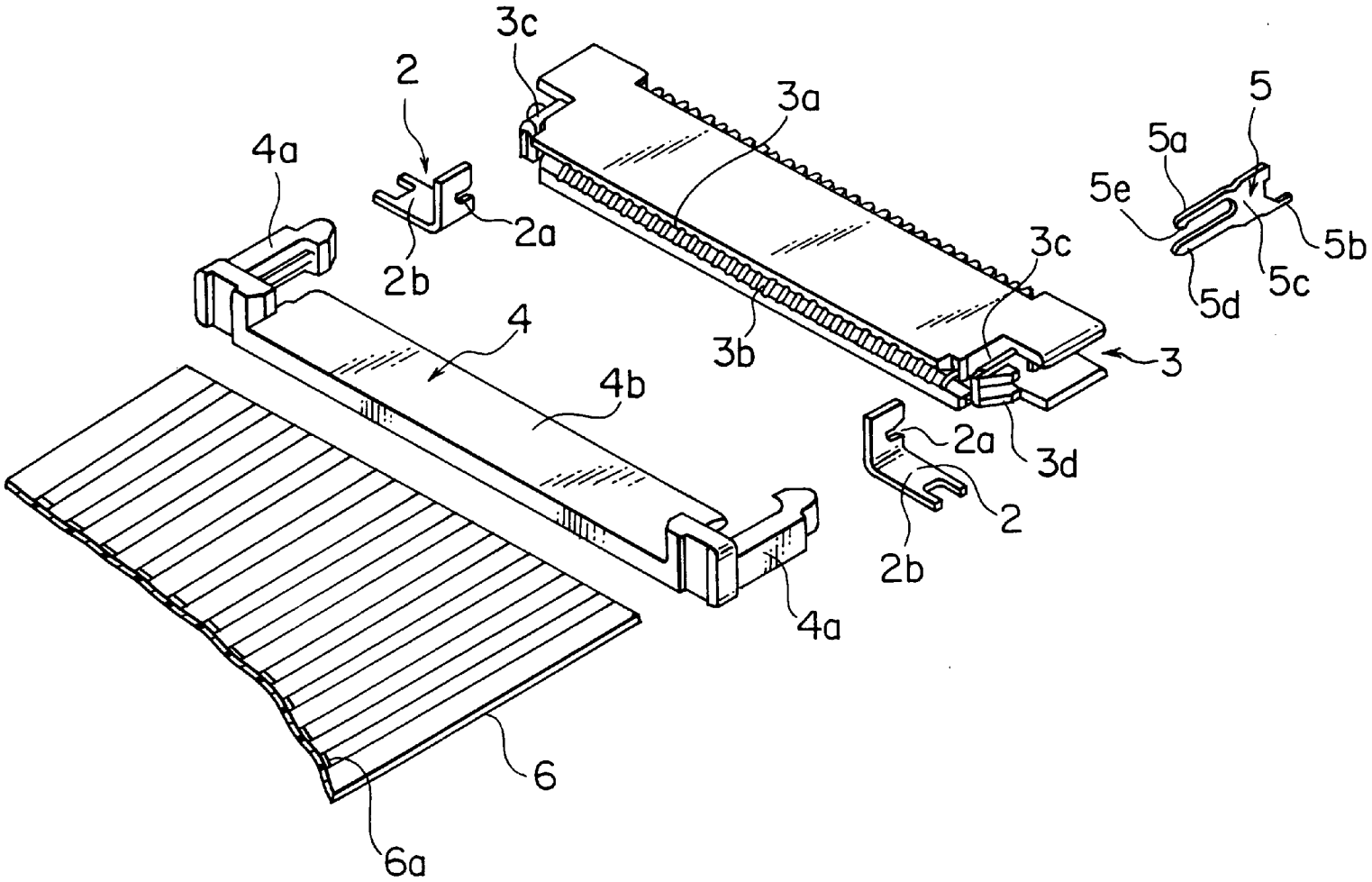
FIG. 1 PRIOR ART
FIG. 1 is an exploded perspective view of a conventional electrical connector.
Figure 2:
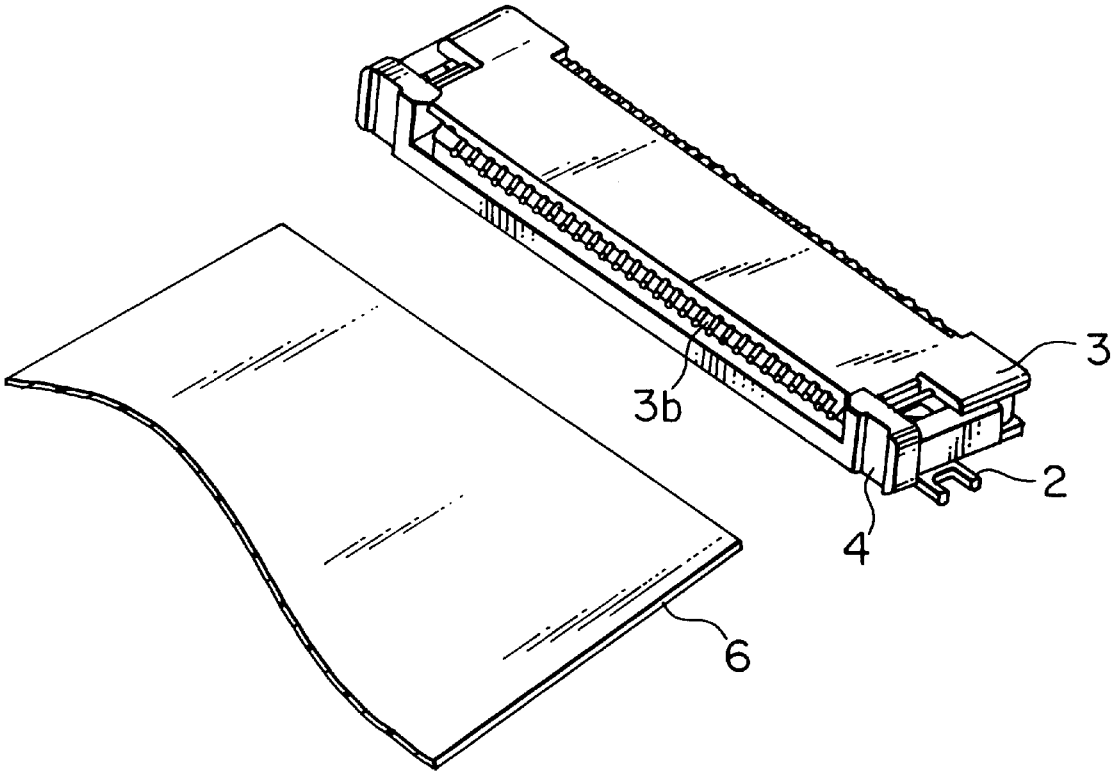
FIG. 2 PRIOR ART
FIG. 2 is a perspective view of the electrical connector in FIG. 1 before an FPC is connected thereto.
Figure 3:
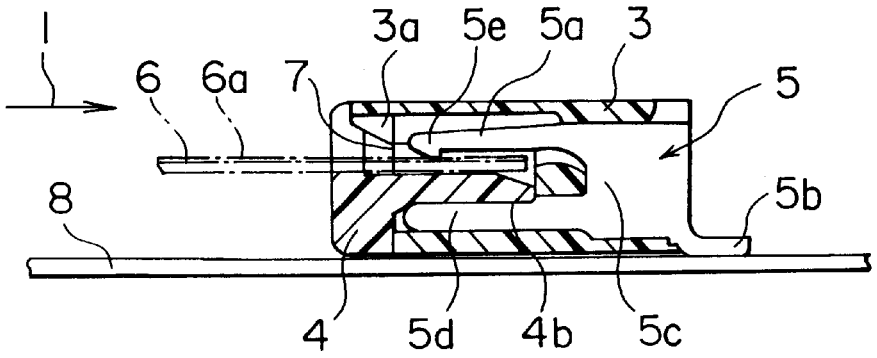
FIG. 3 PRIOR ART
FIG. 3 is a side sectional view of the electrical connector in FIG. 1 when the FPC is connected thereto.

Referring to FIGS. 1 through 3, a conventional electrical connector comprises a base insulator 3, a pair of generally L-shaped holddowns 2 for fixedly holding the base insulator 3 mounted on a circuit board 8 (FIG. 3) such as a printed circuit board, a slide insulator 4 to be combines with the base insulator 3, a plurality of conductive contacts 5 fitted in the base insulator 3, and a wiring member object (herein, an FPC) 6 to be brought into electrical contact with the contacts 5.

The contacts 5 are formed by punching a single conductive plate of a thin thickness with a punch press. Each contact 5 has a contacting portion 5*a,* a holding portion 5*c* connected to one end of the contacting portion 5*a,* a terminal portion 5*b* connected to the holding portion 5*c* and extending in a direction opposite to the contacting portion 5*a,* and an engaging portion 5*d* extending from the holding portion 5*c* in parallel to the contacting portion 5*a* with a predetermined space kept from the contacting portion 5*a*.

The contacting portion 5*a* has a contacting point 5*e* protruding therefrom to be brought into contact with a plurality of conductive patterns 6*a* formed on one surface of the FPC 6. The terminal portion 5*b* protrudes outward from the base insulator 3.

The base insulator 3 has a hollow insert cavity 7 (FIG. 3) and a number of comb-like upper and lower projecting pieces 3*a* and 3*b* formed on upper and lower walls of the base insulator 3, respectively, for fitting the contact 5 inserted from a side opposite to the FPC 6. Between the upper and the lower projecting pieces 3*a* and 3*b,* the contacting portion 5*a* and the engaging portion 5*d* of each contact 5 are fitted. The base insulator 3 has a pair of engaging pieces 3*c* formed at longitudinal opposite ends thereof. Between each of the engaging pieces 3*c* and the base insulator 3, a space for receiving each of the holddowns 2 is defined and a protrusion (not shown) is formed to be inserted into an engaging groove 2*a* formed at an upper side of each of the holddowns 2. The holddowns 2 have lower portions 2*b* mounted on the circuit board 8 and fixed by screws.

The slide insulator 4 has a pair of locking protrusions 4*a* formed at longitudinal opposite ends thereof to be engaged with the engaging pieces 3*c,* respectively. Each of the engaging pieces 3*c* is provided with tapered locking portions 3*d.* A combination of the locking portions 3*d* and the locking protrusions 4*a* of the slide insulator 4 forms a locking mechanism.

The slide insulator 4 has sliding plate 4*b* to be inserted into the insert cavity of the base insulator 3.

The electrical connector of the above-mentioned structure is assembled as follows. In the disassembled state illustrated in FIG. 1, the holddowns 2 are attached to the base insulator 3. The slide insulator 4 is slid towards the base insulator 3 so that the locking protrusions 4*a* are locked to the locking portions 3*d* of the base insulator 3. The assembled state is shown in FIGS. 2 and 3.

As seen from FIG. 2, the lower portions 2*b* of the holddowns 2 protrude outward from the longitudinal opposite ends of the base insulator 3. As seen from FIG. 3, the engaging portion 5*d* of each contact 5 is fitted between the base insulator 3 and the sliding plate 4*b* of the slide insulator 4. A gap is formed between the upper projecting pieces 3*a* and the sliding plate 4*b* of the slide insulator 4. The contact point 5*e* of the contacting portion 5*a* of each contact 5 protrudes above-mentioned gap. The FPC 6 is inserted between the contact points 5*e* and the sliding plate 4*b*. The contact points 5*e* are put into contact with the conductive patterns 6*a* of the FPC 6 in one-to-one correspondence. Each contact point 5*e* is brought into contact with each conductive pattern 6*a* in a direction perpendicular to an inserting direction depicted at I in FIG. 3. When the conductive patterns 6*a* are located at a predetermined position in the insert cavity 7, the FPC 6 is pressed by the sliding plate 4*b* to be put into contact with the contacting points 5*e*.

The FPC is inserted into the insert cavity 7 together with the slide insulator 4. Then, the contacting portions 5*a* are faced to the conductive patterns 6*a* in one-to-one correspondence and the FPC 6 is pressed by the sliding plate 4*b* of the slide insulator 4. In this condition, the contacting points 5*e* and the conductive patterns 6*a* are brought into one-to-one contact.

In the meanwhile, the terminal portions 5*b* of the contacts 5 are soldered and electrically connected to a plurality of conductive portions of the circuit board 8 in one-to-one correspondence.

With the above-mentioned structure, the FPC 6 is put into contact with the contacting points 5*e* under a pressing force of the sliding plate 4*b* to be simply clamped between the sliding plate 4*b* and the contacting portions 5*a* having elasticity. Therefore, the slide insulator 4 is used as the connecting member for connecting the FPC 6 to the electrical connector mounted on a printed circuit.

The electrical connection by use of the slide insulator inserted into the electrical connector together with the wiring member has problems as described in the preamble.

Now, description will proceed to this invention in conjunction with several preferred embodiments thereof.

According to this invention, an electrical connector is used as a connecting member for connecting a wiring member such as FPC to another electrical connector mounted on an electrical device such as a printed circuit board. Although it is easy to connect the electrical connector to an end of the FPC, it is impossible to remove the connector from the FPC once both are connected.

Figure 4:
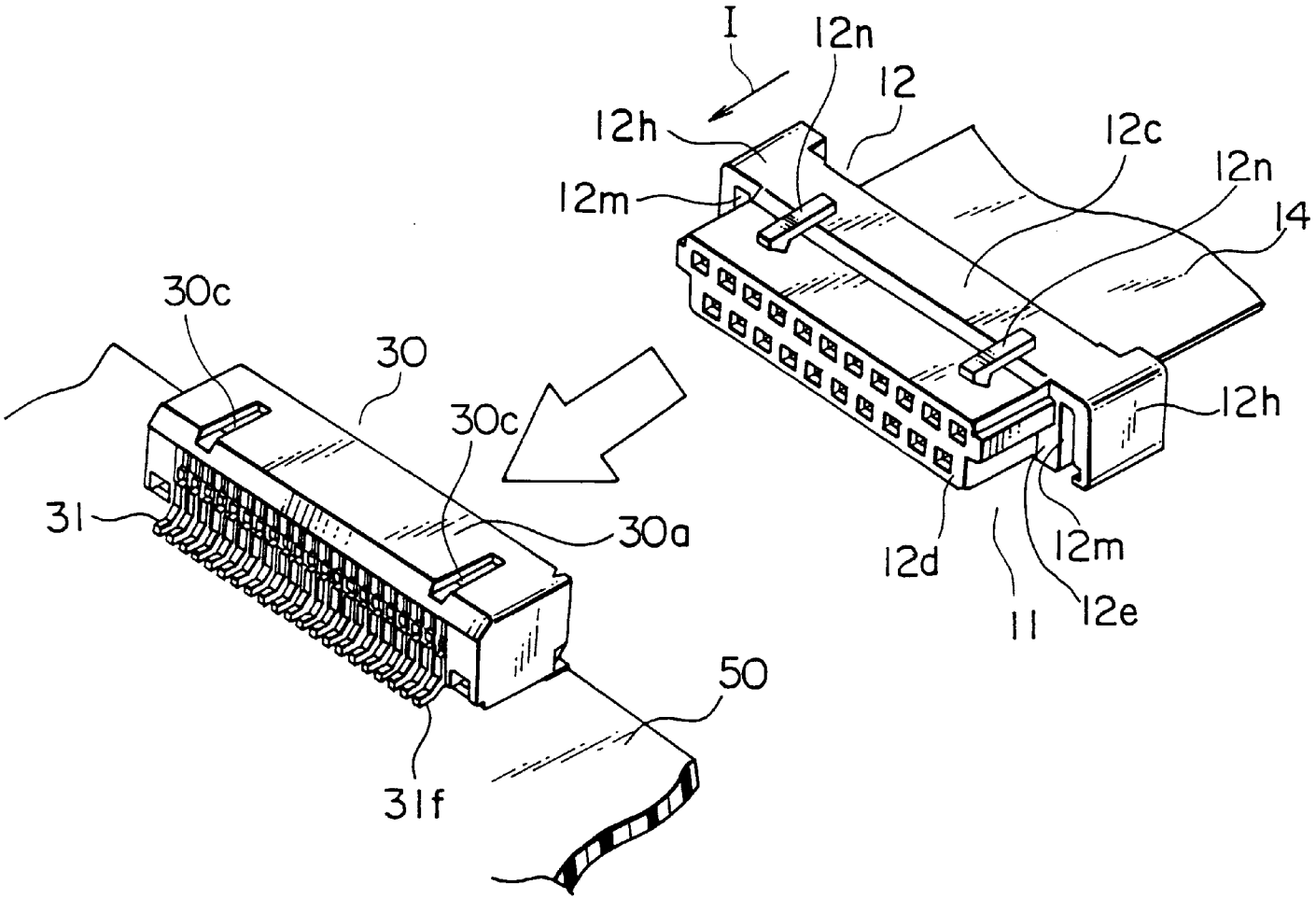
FIG. 4 is a perspective view of an electrical connector according to a first embodiment of this invention before it is coupled to a mating connector.
Figure 5:
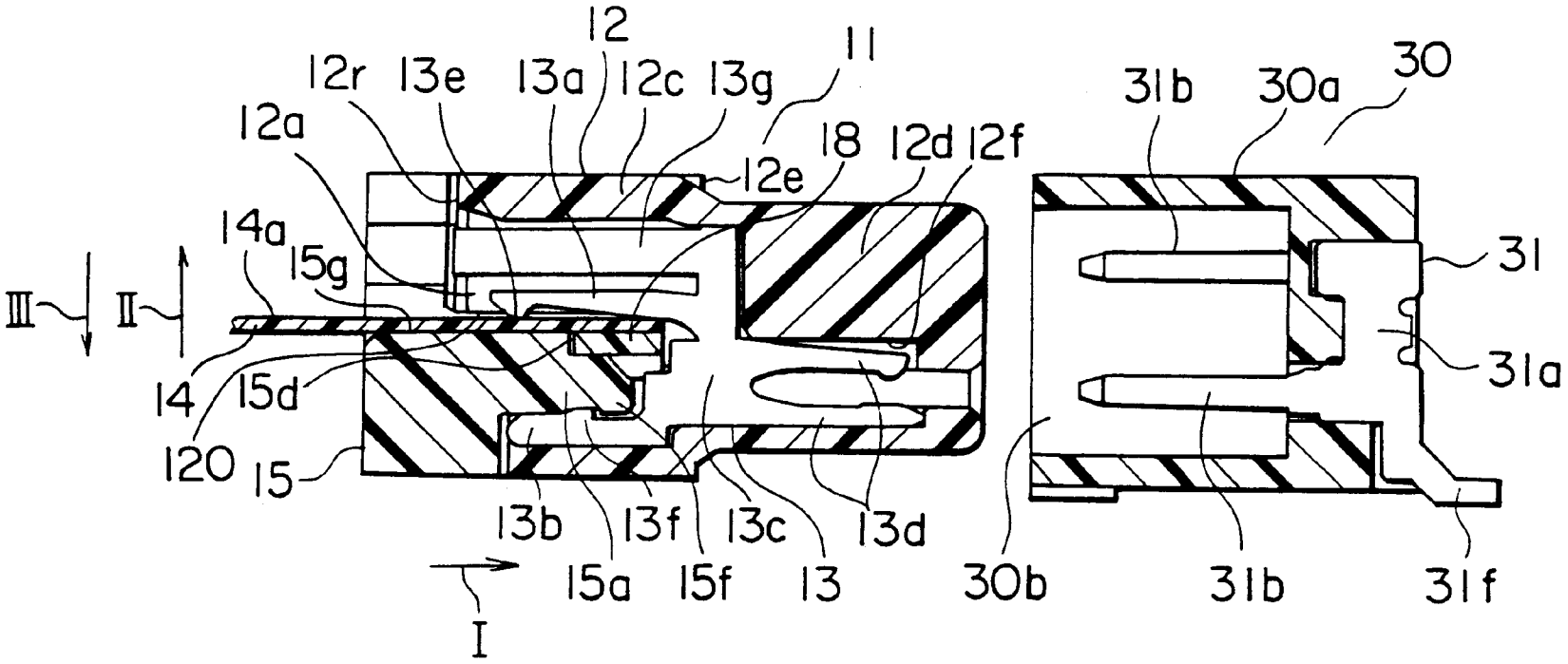
FIG. 5 is a cross sectional view of the electrical connector in FIG. 4 before it is couple to the mating connector.

Referring to FIGS. 4 and 5, an electrical connector 11 as a connecting member according to a first embodiment of this invention is electrically and mechanically connected to one end of an FPC 14. The electrical connector 11 is used as a relay connector for electrically connecting a first electric apparatus connected to the other end of the FPC 14 and a second electric apparatus having a mating connector 30. The mating connector 30 is mounted on a circuit board 50 such as a printed circuit board.

The electrical connector 11 comprises an insulator 12, a plurality of conductive contacts 13 fitted in the insulator 12 and arranged in parallel to one another at a predetermined interval, and a slide insulator 15 for bringing the FPC 14 into contact with the contacts 13.

The insulator 12 has a base portion 12*c*, an insert cavity 120 defined in the base portion 12*c* to receive the FPC 14 and the slide insulator 15 in an inserting direction depicted at I in FIGS. 4 and 5, and a plurality of contact rooms 12*a* each connecting the insert cavity 120. The insulator 12 further has a fitting portion 12*d* formed on a base surface 12*e* of the base portion 12*c* to be coupled to the mating connector 30.

Each contact 13 is disposed in each of the contact rooms 12*a*. Each contact 13 has a holding portion 13*c* fixed to an inner wall of the contact room 12*a*, a first contacting portion 13*a* extending within the contact room 12*a* along the insert cavity 120 from the holding portion towards an opening end 12*r* of the insert cavity 120 in the inserting direction I, and an engaging portion 13*b* also extending within the contact room 12*a* in the inserting direction I from the holding portion towards the opening end 12*r* of the insert cavity 12*a* in parallel to the first contacting portion 13*a* with a predetermined space therebetween. The contact 13 further has a second contacting portion 13*d* of a socket-like shape extending from the holding portion 13*c* and received in an insertion hold 12*f* formed in the fitting portion 12*d*, and an additional holding portion 13*g* extending from the opening end 12*r* in the inserting direction I above the first contacting portion 13*a* and connected to the holding portion 13*c*.

The contacts 13 are formed by punching a conductive plate of a thin thickness with a punch press.

The first contacting portion 13*a* has a contacting point 13*e* projecting into insert cavity 120 to be brought into contact with a corresponding one of conductive patterns 14*a* of the FPC 14. The contacting point 13*e* protrudes from a free end of the first contacting portion 13*a* in a first direction (depicted at II in FIG. 5) and perpendicular to the inserting direction I to project into the insert cavity 120. The contacting point 13*e* is substantially faced to a top end of the engaging portion 13*b*.

The slide insulator 15 has a slider insert portion 15*a* to be inserted into the insert cavity 120 and between the first contacting portion 13*a* and the engaging portion 13*b* in the inserting direction I. The slide insulator 15 is provided with a flat reciving surface 15*g* for mounting the FPC 14. When the slider insert portion 15*a* and an end portion of the FPC 14 are inserted to a predetermined position of the insert cavity 120, the FPC 14 is pressed by the slider insert portion 15*a* towards the contacting point 13*e*, namely, in the first direction II.

When the slider insert portion 15*a* and the FPC 14 are not inserted into the insert cavity 120, the first contacting portion 13*a* is slightly inclined in a second direction (depicted at III in FIG. 5) opposite to the first direction II. In this state, the first contacting portion 13*a* exhibits zero elastic force.

Figure 6:
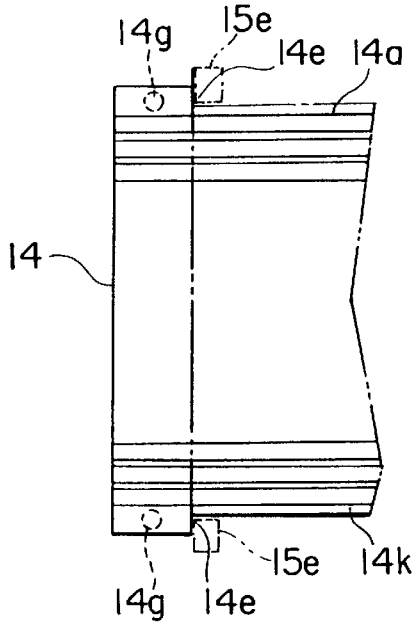
FIG. 6 is a plan view of an example of an FPC illustrated in FIG. 4.
Figure 7:
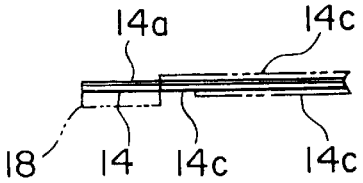
FIG. 7 is a side view of the FPC illustrated in FIG. 6.

As illustrated in FIGS. 6 and 7 in detail, the FPC 14 has a strap-like flat shape and a flexible nature. The FPC 14 comprises a flexible insulating base member 14*k*, and a plurality of conductive patterns 14*a* formed on one surface of the insulating base member 14*k*. The conductive patterns 14*a* are arranged in parallel to one another in a widthwise direction of the insulating base member 14*k* at a predetermined interval. Each conductive pattern 14*a* extends in a longitudinal direction on the one surface of the insulating base member 14*k*. As shown in FIG. 7, a thin insulating member 14*c* is coated onto the insulating base member 14*k* and the conductive patterns 14*a* except an end portion of both surfaces. End portions of the conductive patterns 14*a* are exposed to form exposed ends for transmitting and receiving electric signals to and from contacting elements engaged therewith. As shown in FIG. 7, another thin insulating member 14*c* may preferably be coated onto the opposite side of the insulating base member 14*k*.

Figure 8:
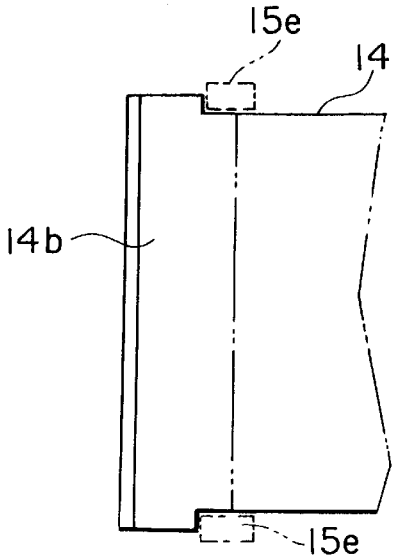
FIG. 8 is a rear view of another example of the FPC illustrated in FIG. 4.

The electric connector according to the first embodiment is typically connected to the FPC 14 with the conductive patterns 14*a* formed on the one surface thereof, as illustrated in FIGS. 6 and 7. Alternatively, use can be made of the FPC 14 of the typed illustrated in FIG. 8. In addition to the conductive pattern 14*a,* this FPC 14 has a grounding conductive pattern 14*b* formed on the other surface opposite to the one surface with the conductive patterns 14*a*. In the illustrated FPC 14, the grounding conductive pattern 14*b* is formed on one end of the other surface of the insulating base member 14*k*.

The electrical connector 11 of the type adapted for use with the FPC 14 having the grounding conductive pattern 14*b* will later be described.

Turning back to FIG. 5, the slider insert portion 15*a* of the slide insulator 15 has first and second engaging arrangements. The first engaging arrangement is engaged with the FPC 14 to inhibit the FPC 14 from moving in a releasing direction opposite to the inserting direction I when the slider insert portion 15*a* and the end portion of the FPC 14 are located at the predetermined position in the insert cavity 120 of the base portion 12*c*. The second engaging arrangement is engaged with the engaging portion 13*b* of the contact 13 in the releasing direction when the slider insert portion 15*a* is located at the predetermined position.

The FPC 14 is provided with a reinforcing member 18 of a long plate shape formed at the top end portion of the other surface thereof. The reinforcing member 18 preferably comprises an insulating material. The reinforcing member projects downwards and engages with the first engaging arrangement of the slider insert portion 15*a*.

The first engaging arrangement comprises an engaging step portion 15*d* formed on the slider insert portion 15*a* in the form of a descending step to be faced to and engaged with the reinforcing member 18 in the releasing direction. The reinforcing member 18 has a thickness greater than the FPC 14 itself.

The engaging portion 13*b* of the contact 13 is provided with a contact-side engaging protrusion 13*f*. The contact-side engaging protrusion 13*f* protrudes towards the first engaging portion 13*a*. The second engaging arrangement has a slider-side engaging recess 15*f* formed in the slider insert portion 15*a* to be faced to and engaged with the contact-side engaging protrusion 13*f* in the releasing direction.

On the other hand, the mating connector 30 comprises a mating insulator 30*a* and a plurality of conductive mating contacts 31 fitted in the mating insulator 30*a,* as illustrated in FIGS. 4 and 5. The mating insulator 30*a* has a mating fitting portion 30*b* formed as a cavity having a size sufficient to be coupled with the fitting portion 12*d*.

Each of the mating contact 31 has a holding portion 31*a* held in the mating insulator 30*a,* a pin-like mating contacting portion 31*b* extending from the holding portion 31*a* in the releasing direction to be releasably connected to the second contacting portion 13*d* of the contact 13, and a terminal portion 31*f* extending from the holding portion 31*a* outward of the mating insulator 30*a* to be soldered to a corresponding one of a plurality of conducting portions of the circuit board 50 contained in an electric apparatus. In this embodiment, the mating contacting portions 31*b* are alternately arranged up and down in a longitudinal direction of the mating fitting portion 30*b* to form upper and lower rows within the mating fitting portion 30*b*.

Likewise, both of the second contacting portions 13*d* of the contacts 13 and the insertion holes 12*f* are alternately arranged up and down in a longitudinal direction of the insulator 15.

Referring to FIG. 4, the electrical connector 11 has a pair of hooks 12*n* on an outer surface of the insulator 12. On the other hand the mating connector 30 has a pair of grooves 30*c* in an outer surface of the mating insulator 30*a*. When the both connectors 11 and 13 are mated with each other, they are locked and maintained in the connection condition. Therefore, the connection condition is not destroyed by vibration of the electric apparatus, at all. The hooks 12*n* have elasticity so that the hooks 12*n* can be elastically bent to go out of the grooves 30*c*. Therefore, both connectors 11 and 30 can be easily disconnected.

Thus, it is preferably that the pair of connectors mating each other has releasable connector locking means for maintaining the connection condition.

Next referring to FIGS. 9 through 12, description will be made in detail as regard attachment of FPC 14 to the electrical connector 11.

Figure 9:
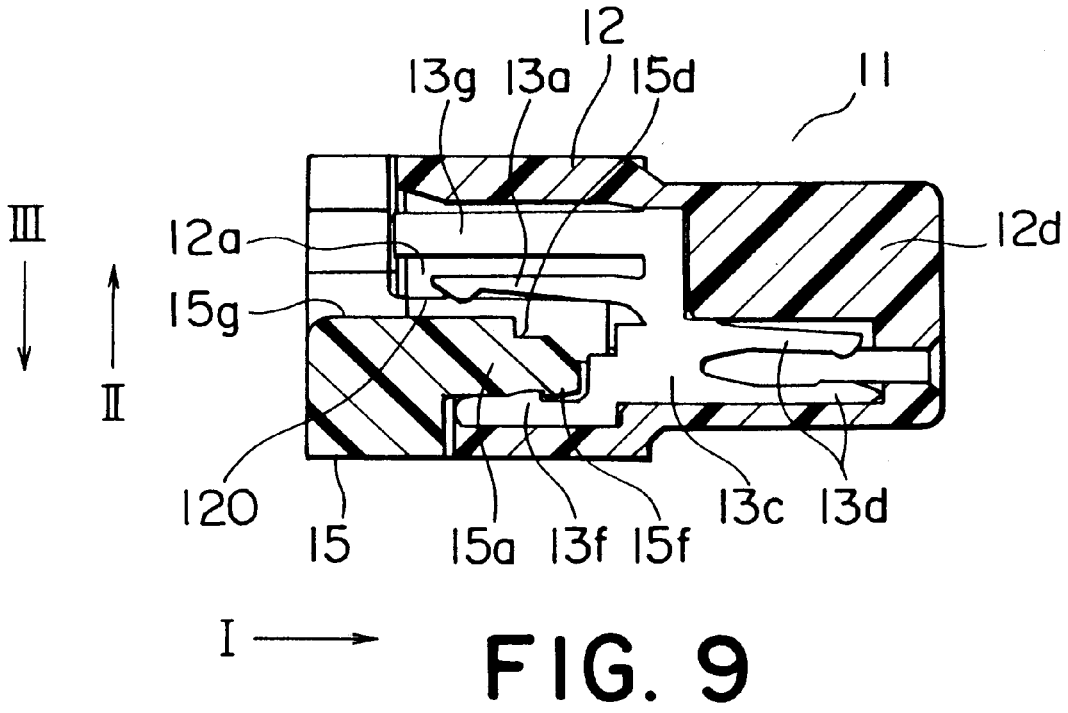
FIG. 9 is a cross section view of the electrical connector illustrated in FIG. 5.

Referring to FIG. 9, the electrical connector 11 is illustrated before the FPC 14 is inserted into the insert cavity 120 of the insulator 12. In the illustrated state, the slide insulator 15 can be moved in the inserting direction I, the releasing direction, the first direction II, and the second direction III. In the figure, the slider-side engaging recess 15*f* of the slider insert portion 15*a* is engaged with the contact-side engaging protrusion 13*f*. Since the slider insert portion 15*a* is engaged with the engaging portion 13*b* but is still movable in the space between the first contacting portion 13*a* and the engaging portion 13*b* of the contact 13, the slide insulator 15 can be moved in the inserting direction I, the releasing direction, the first direction II, and the second direction III. Therefore, as illustrated in FIG. 9, the slider-side engaging recess 15*f* can be disengaged from the contact-side engaging protrusion 13*f* so that the slide insulator 15 is released from the insulator 12.

Figure 10:
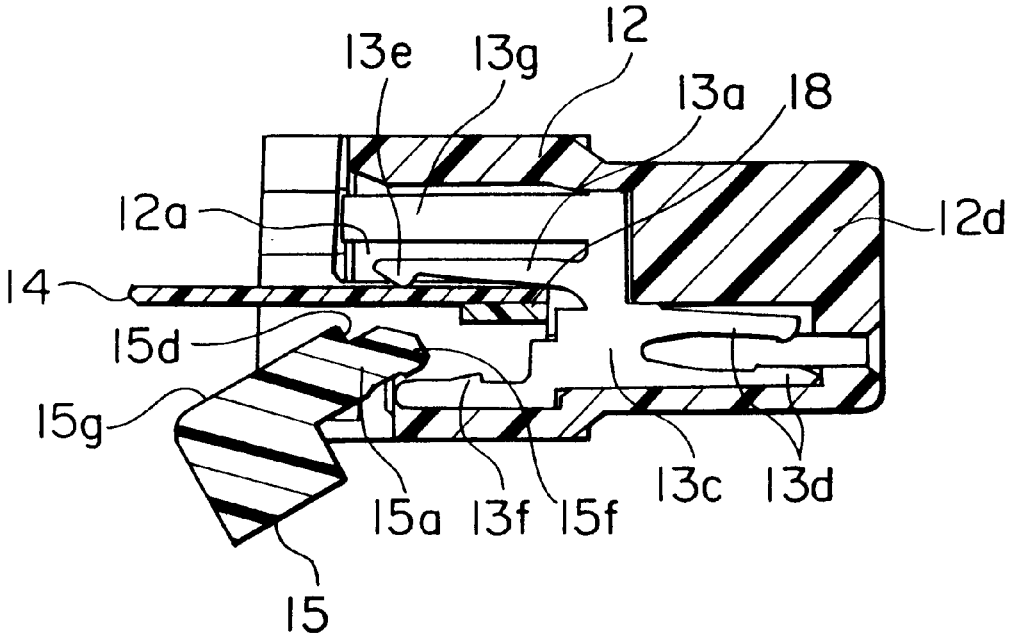
FIG. 10 is a cross sectional view of the electrical connector in a state where the FPC is inserted into the electrical connector and a slide insulator is movably engaged with a base insulator.
Figure 11:
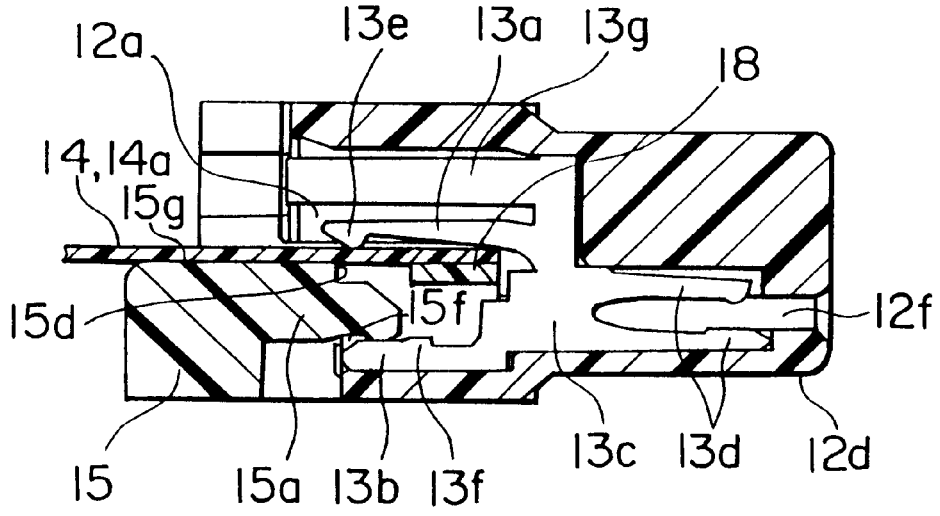
FIG. 11 is a cross sectional view similar to FIG. 10 in a state where the slide insulator is being inserted into the base insulator.
Figure 12:
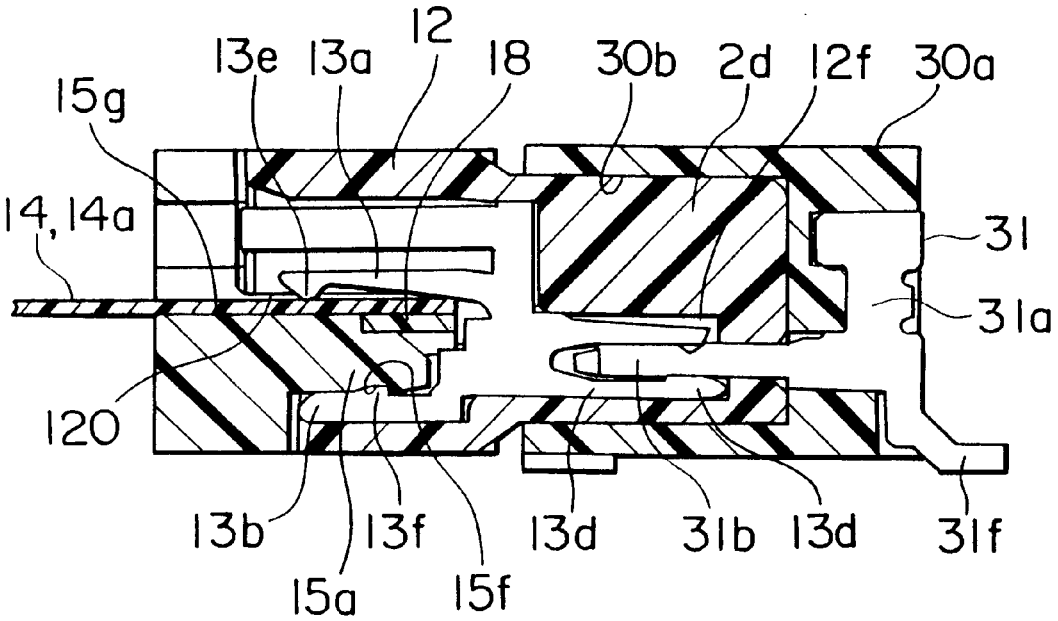
FIG. 12 is a side sectional view similar to FIG. 11 in a state where the slide insulator is inserted to a predetermined position in the base insulator and the electrical connector is coupled to the mating connector.

In order to bring the FPC 14 into contact with the first contacting portion 13, the slide insulator 15 is removed from the state illustrated in FIG. 9. Then, as illustrated in FIG. 10, the FPC 14 is inserted towards the holding portion 13*c* with the reinforcing member 18 directed forward in the inserting direction I and faced downward to the engaging portion 13*b*. Thereafter, as illustrated in FIG. 11, the slide insulator 15 is relocated to support on the receiving surface 15*g* that part of the FPC 14 which is adjacent to the top end portion. Then, the slide insulator 15 is inserted into the insert cavity 120 in the inserting direction I. As a consequence, a leading end of the slider insert portion 15*a* is moved inward in the insert cavity 120. At this time, the reinforcing member 18 of the FPC 14 is located at the inner part of the insert cavity 120. When the slide insulator 15 is further moved in the inserting direction I to reach the predetermined position, the reinforcing member 18 and the engaging step portion 15*d* of the slider insert portion 15*a* are engaged with each other, as illustrated in FIG. 12. Simultaneously, the contact-side engaging protrusion 13*f* and the slider-side engaging recess 15*f* are engaged with each other. Therefore, the FPC 14 and the slide insulator 15 are inhibited from being moved in the releasing direction.

In the above-mentioned state, the receiving surface 15*g* which is an upper surface of the slider insert portion 15*a* presses the FPC 14 towards the contacting points 13*e* of the contacts 13. Therefore, the conductive patterns 14*a* are kept in contact with the contacting points 13*e* under appropriate pressing force of the slider insert portion 15*a* in addition to elastic force of the contacting portions 13*a* of a leaf spring shape.

In the condition illustrated in FIG. 12, the FPC 14 and the slide insulator 15 can not be moved in any one of the inserting direction I, the releasing direction, the first direction II, and the second direction III shown in FIG. 9. If the FPC 14 is forcibly pulled out in the releasing direction, any one of the FPC 14, the slide insulator 15, the reinforcing member 18, and the insulator 12 will be broken. Therefore, the electrical connector 11 of the above-mentioned structure assures permanent connection of the FPC 14.

Thus, the slide insulator 15 and the FPC 14 are locked in the electrical connector 11 and can not be removed therefrom without destroying the connector.

Figure 13:
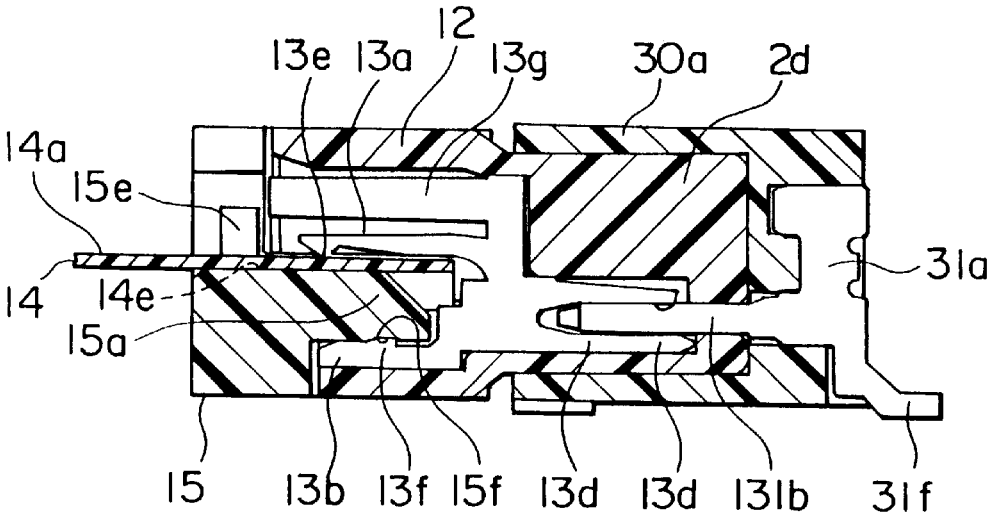
FIG. 13 is a sectional view of an electrical connector according to a second embodiment of this invention when it is coupled to a mating connector.
Figure 14:
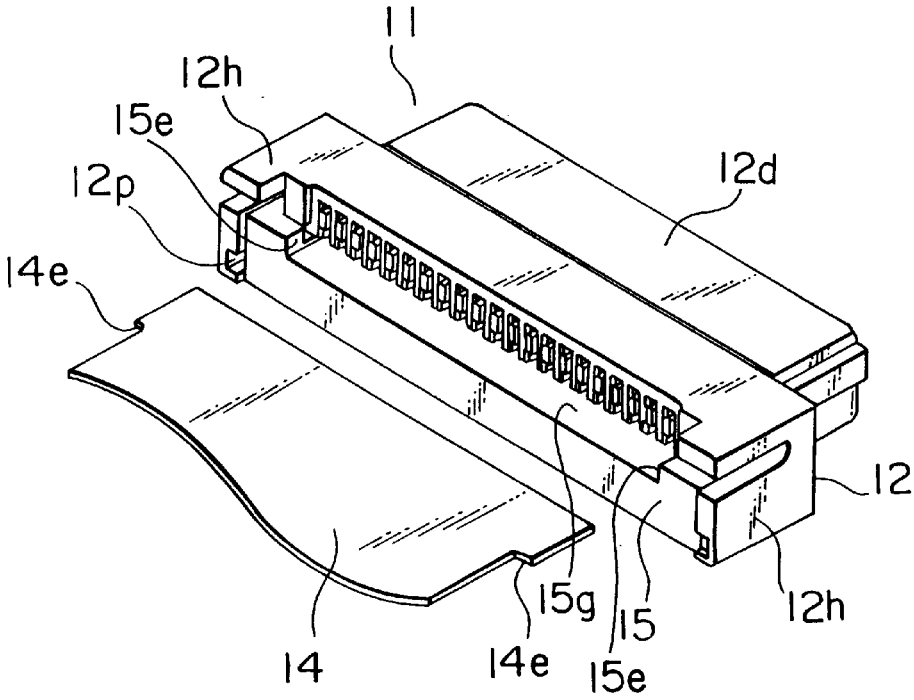
FIG. 14 is a perspective view of the electrical connector in FIG. 13 before the FPC is connected thereto.

Referring to FIGS. 13 and 14, the electrical connector 11 according to a second embodiment of this invention is similar to the first embodiment except the structures of the first engaging arrangement and the FPC 14 to be engaged by the first engaging arrangement. In this embodiment, the engaging step portion 15*d* and the reinforcing member 18 in the first embodiment are replaced by different structures which will hereafter be described. Similar parts are designated by like reference numerals and will not be described in detail.

The electrical connector 11 in the second embodiment is for use with the FPC 14 illustrated in FIG. 6. As seen from FIGS. 6 and 13, the FPC 14 has a pair of step portions 14*e* formed by widening the leading end portion of the FPC 14. The first engaging arrangement is formed on the slide insulator 15. As illustrated in FIGS. 6, 13, and 14, the first engaging arrangement comprises a pair of protrusions 15*e* formed on the receiving surface 15*g* of the slide insulator 15 to be engaged with the step portions 14*e* of the FPC 14 in the releasing direction.

Like in the first embodiment, the second engaging arrangement comprises the slider-side engaging recess 15*f*. The slider-side engaging recess 15*f* is engaged with the contact-side engaging protrusion 13*f* formed on the engaging portion 13*b* of the contact 13.

The slide insulator 15 is inserted into the insert cavity 120*a* with the protrusions 15*e* respectively engaged with the step portions 14*e* in the releasing direction as shown in FIGS. 6, 13, and 14. When the predetermined position is reached, the conductive patterns 14*a* are brought into contact with the contacting points 13*e* in one-to-one correspondence.

Instead of use of the step portions 14*e*, the FPC 14 in the second embodiment may have a pair of insertion holes 14*g* (depicted at dotted-line circles in FIG. 6) formed in the widened portions at both sides of thereof, and a pair of protrusions (not shown) are formed on the receiving surface 15*g* of the slide insulator 15 to be fitted in the insertion holes 14*g*.

Figure 15:
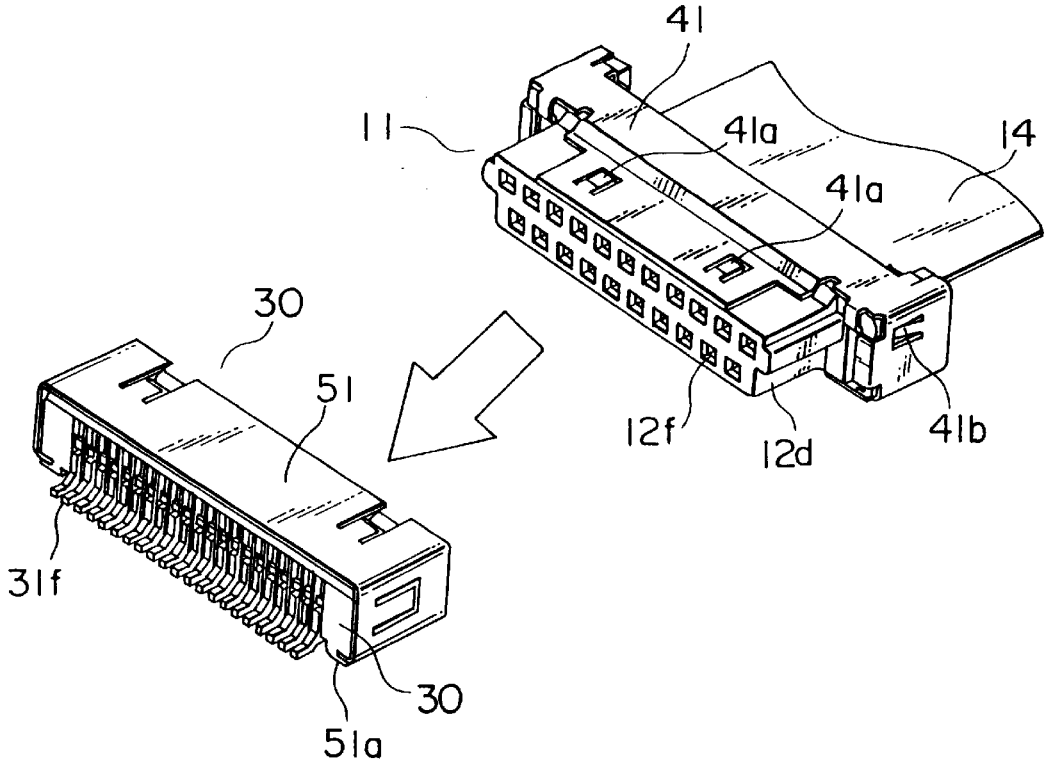
FIG. 15 is a perspective view of an electrical connector according to a third embodiment of this invention before it is coupled to a mating connector.
Figure 16:
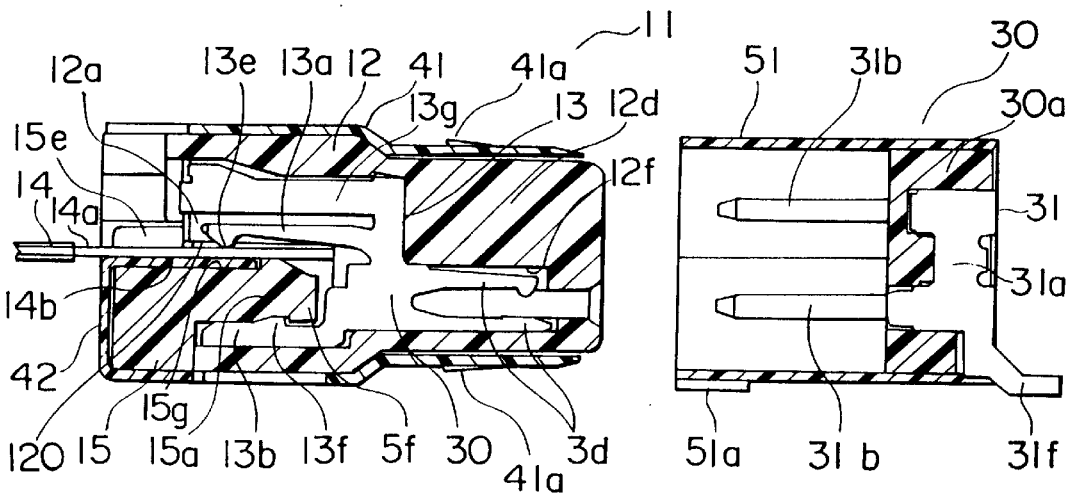
FIG. 16 is a cross sectional view of the electrical connector in FIG. 15 before it is coupled to the mating connector.

Referring to FIGS. 15 and 16, the electrical connector 11 according to a third embodiment of this invention is substantially similar to that of the second embodiment illustrated in FIG. 13. Similar parts are designated by like reference numerals and will not be described. The electrical connector 11 in this embodiment is for use with the FPC 14 having the conductive patterns 14*a* formed on one surface as signal lines and the grounding conductive pattern 14*b* formed on the other surface opposite to the one surface, as described in conjunction with FIG. 8. This structure enables both signal line connection and ground connection.

As seen from FIGS. 15 and 16, the insulator 12 has an outer surface covered by a conductive base shell member 41. The base shell member 41 is formed by punching and bending a thin conductive plate. On an under the fitting portion 12*d*, the base shell member 41 is provided with a pair of first cut-and-bent pieces 41*a* formed by cutting and outwardly bending small parts of each of upper and lower walls of the base shell member 41, and a pair of second cut-and-bent pieces 41*b* formed by cutting and inwardly bending small parts of both side walls.

The slide insulator 15 has an outer surface covered with a conductive slide shell member 42 except a part faced to the engaging portions 13*b* of the contacts 13. The FPC 14 is placed on the slide shell member 42 on the receiving surface 15*g* which is the upper surface of the slider insert portion 15*a*. The grounding conductive pattern 14*b* of the FPC 14 is brought into contact with the slide shell member 42 on the receiving surface 15*g*. The FPC 14 is clamped between the contacting points 13*e* of the contacts 3 and the slide shell member 42.

The first engaging arrangement comprises a pair of the protrusions 15*e* formed on the slide insulator 15 to engage in the releasing direction a pair of the step portions 14*e* formed by widening the leading end portion of the FPC 14, in the manner similar to that described in conjunction with FIGS. 6, 13, and 14. The second engaging arrangement comprises the slider-side engaging recess 15*f* formed in the slider insert portion 15*a* of the slide insulator 15 to be engaged in the releasing direction with the contact-side engaging protrusion 13*f* formed on the engaging portion 13*b* of the contact 13.

The slide insulator 15 is inserted into the insert cavity 120 with the protrusions 15*e* on the slider mount surface 15*e* engaged with the step portions 14*e* of the FPC 14 in one-to-one correspondence. Then, the conductive patterns 14*a* as the signal lines are brought into contact with the contacting points 13*e* at the predetermined position. At this time, the grounding conductive pattern 14*b* is put into contact with the slide shell member 42. Simultaneously, opposite side surfaces of the slide shell member 42 are put into contact with the second cut-and-bent pieces 41*b* of the base shell member 41.

On the other hand, the mating connector 30 comprises the mating insulator 30*a*, the conductive mating contacts 31 fitted in the mating insulator 30*a*, and a mating shell member 51 covering the mating insulator 30*a* and the mating contacts 31*b* so as to fit the fitting portion 12*d* therein. The mating shell member 51 is fixed to a grounding conductive portion of the circuit board 50 through holddowns 51*a* formed on the mating shell member 51, as illustrated in FIG. 16.

When the electrical connector 11 and the mating connector 30 are coupled to each other, the contacts 13 and the mating contacts 31 are connected to each other to enable signal transmission and reception. Simultaneously, the grounding conductive pattern 14*b* is connected to ground through the slide shell member 42, the second cut-and-bent pieces 41*b* of the base shell member 41, the base shell member 41, the first cut-and-bent pieces 41*a* of the base shell member 41, the mating shell member 51, and the holddowns 51*a*, and the grounding conductive portion of the circuit board 50.

Figure 17:
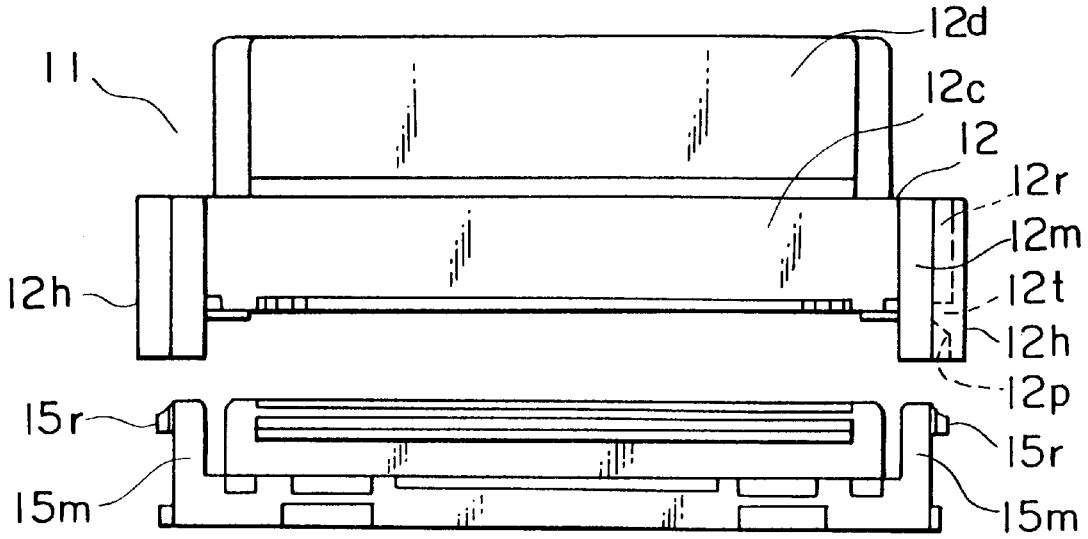
FIG. 17 is a plan view of the electrical connector in FIG. 15 with a base insulator and a slide insulator separated.
Figure 18:
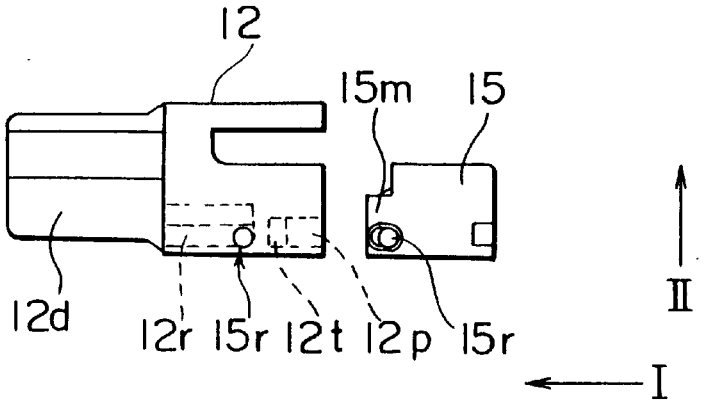
FIG. 18 is a side view of the base insulator and the slide insulator illustrated in FIG. 17.
Figure 19:
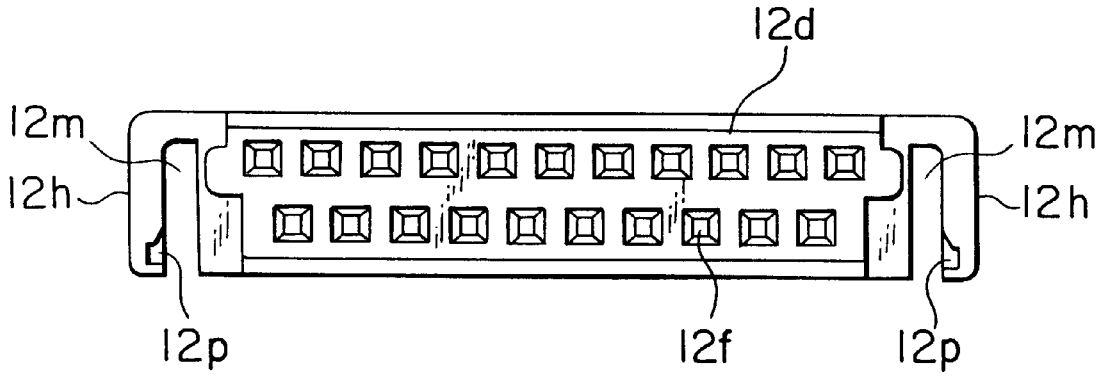
FIG. 19 is a front view of the base insulator in FIG. 17.

Referring to FIGS. 17 through 19, the electrical connector 11 according to a fourth embodiment of this invention is related to an engaging structure between the insulator 12 and the slide insulator 15 in the electrical connector 11. Similar parts are designated by like reference numerals and will not be described in detail.

Referring to FIGS. 4, 9, 10, 17 through 19, the insulator 12 comprises the base portion 12*c* with the insert cavity 120 defined therein, and the fitting portion 12*d* formed on the base surface 12*e* of the base portion 12*c* to be fitted to the mating fitting portion 30*b* of the mating connector 30.

The base portion 12*c* has block portions 12*h* formed on both sides thereof. Each block portion 12*h* is provided with a base-side engaging recess 12*m* extending from the bottom in the inserting direction I and the first direction II.

The base-side engaging recess 12*m* has an internal wall surface provided with a first guide groove 12*p* extending from the open end of the insert cavity 120 in the inserting direction I, a second guide groove 12*r* continuously extending from the first guide groove 12*p* in the inserting direction I, and a first projecting portion 12*t* formed between the first and the second guide grooves 12*p* and 12*r*.

The slide insulator 15 has a pair of engaging plates 15*m* formed on longitudinal opposite sides thereof to be fitted in the base-side engaging grooves 12*m* in the inserting direction I. Each of the engaging plates 15*m* is provided with a second projecting portion 15*r* formed on an outer surface thereof.

When the slide insulator 15 is inserted into the insert cavity 120, the engaging plates 15*m* are inserted into the first guide grooves 12*p*, respectively. Each of the second projecting portion 15*r* passes through the first guide groove 12*p*, over the first projecting portion 12*t*, and into the second guide groove 12*r* to be engaged therewith in the releasing direction.

As seen from FIG. 17, the first projecting portion 12*t* has a slant surface and an orthogonal surface at the sides of the first and the second guide grooves 12*p* and 12*r*, respectively. With this structure, the second projecting portion 15*r* easily passes over the slant surface of the first projecting portion 12*t* in the inserting direction I. On the other hand, in the releasing direction, the second projecting portion 15*r* is received by the orthogonal surface of the first projecting portion 12*t*. With this structure, the slide insulator 15 can not easily released when it is located at the predetermined position within the insert cavity 120. In FIG. 18, the second projecting portion 15*r* inserted into the second groove 12*r* is depicted by a real-line circle.

When the second projecting portions 15*r* are inserted into the second guide grooves 12*r*, the slide insulator 15 can be rotated with the second projecting portions 15*r* as the center of rotation, as illustrated in FIG. 10. In this state, the FPC 14 is inserted into the insert cavity 120. Thereafter, the slide insulator 15 is rotated to the position illustrated in FIG. 11 and then inserted into the insert cavity 120. At this time, the second projecting portions 15*r* are guided by the second guide grooves 12*r* to be moved inward.

When the slide insulator 15 reaches the predetermined position in the insert cavity 120 as illustrated in FIG. 12, the contacting points 13*e* of the contacts 13 and the conductive patterns 14*a* of the FPC 14 are brought into contact with each other. Simultaneously, the engaging step portion 15*d* as the first engaging arrangement is engaged with the reinforcing member 18 while the slider-side engaging recess 15*f* as the second engaging arrangement is engaged with the contact-side engaging protrusion 13*f* of the contact 13. Thus, connection of the FPC 14 is completed.

As thus far been described, according to this invention, the FPC 14 is engaged with the slide insulator 15 in the releasing direction and the slide insulator 15 is engaged with the contacts 13 in the releasing direction. Therefore, even if the FPC 14 is pulled in the releasing direction, the connection object can not be easily released from the insulator 12 and the slide insulator 15.

Since the slide insulator 15 is engaged with the contacts 13 in the releasing direction and the FPC 14 is engaged with the slide insulator 15 in the releasing direction, sufficient resistant force is assured against pull-out force. Therefore, a compact and high-density arrangement of the contacts is achieved.

According to this invention, it is also possible to meet the demand for permanently maintaining the connection once the FPC 14 is connected to the electrical connector 11.

In addition, the slide insulator 15 and the insulator 12 are integrally held with the second projecting portions 15*r* inserted into and engaged with the second guide grooves 12*r*. Therefore, the slide insulator 15 is easily inserted into the insert cavity 120.

It will be noted that the second and the third embodiments are preferably provided with a releasable connector locking means similar to the locking means shown in FIG. 4, or modified or various connector locking means for the same purpose.

Although the foregoing embodiments have been described in connection with use of FPC as the wiring member, this invention is not restricted to use of FPC, but can be applied to use of FFC and other wiring member.

What is claimed is:

1. A combination of a conductor member and a connecting member for electrically and mechanically connecting said conductor member to an electrical connector, wherein said conductor member comprises:

an elastic insulator element having an end portion and projection means projecting from said end portion; and at least one conductor line supported by said insulator element and having an exposed portion exposed from said insulator element at said end portion, and wherein said connecting member comprises:

at least one contact element of elastic metal to be connected with said exposed portion of said at least one conductor line and to be electrically connected with said electrical connector, said contact element having a contact portion;

an insulator body to be removably and mechanically connected to said electrical connector, said insulator body having at least one contact room in which said at least one contact element is fixedly accommodated, said insulator body further having a hole continuing to said contact room, in which hole said contact portion projects;

a slider of insulator material having a receiving surface for receiving said conductor member and engaging means formed in said receiving surface for engaging with said projection means to prevent said conductor member from moving in a direction opposite to said end portion when said conductor member is received on said receiving surface, said slider being slidable into said hole together with said conductor member whereby said exposed portion comes into contact with said contact portion; and locking means for locking said slider in said hole when said slider inserted into said hole together with said conductor member being received on said receiving surface while said projection means engaging with said engaging means, whereby said conductor member and said slider being prevented from being removed out of said hole in said insulator body.

2. A combination as claimed in claim 1, wherein said locking means comprises said slider having an engaging recess in an surface opposite to said receiving surface, and an engaging projection disposed in said hole for snapping into said engaging recess when said slider is inserted into said hole together with said conductor member.

3. A combination as claimed in claim 2, wherein said engaging projection is a part extending from said contact element.

4. A combination as claimed in claim 1, wherein said conductor member is a flat cable, said at least one conductor line is a strip-like conductor line; and first and second flexible insulator sheets collectively serving as said elastic insulator element, said first and second flexible insulator sheets being laminated together and holding said at least one strip-like conductor line therebetween, said first flexible insulator sheet is short of an end a said end portion to provide said exposed portion of said conductor line.

5. A combination as claimed in claim 4, wherein said second flexible insulator sheet has a projection rib, as said projection means, projecting from a back side opposite to a surface on which said conductor line extends, and said slider has a depression, as said engaging means, in said receiving surface.

6. A combination as claimed in claim 4, wherein said insulator element of said first and said second flexible insulators laminated together has lateral projections, as said projection means, laterally projecting from opposite edges of said insulator element, and said slider has protrusions, as said engaging means.

7. An electrical connector device for electrically connecting a flat wiring member with an electrical device, comprising a pair of first and second connector units mating to each other, said first connector unit being mounted on and electrically connected to said electrical device having terminals, said second connector unit being fixedly connected to an end portion of said flat wiring member, said flat wiring member comprising:

a plurality of strip-like conductor lines spaced from each other;

an insulator element of first and second insulator sheets laminated together and holding said conductor lines therebetween, said first insulator sheet being short of an end at said end portion to provide exposed portions of said conductor lines which portions are exposed from said first insulator sheet; and projection means projecting from said insulator element at said end portion;

wherein said first connector unit comprises:

a first insulator body having a plurality of first contact holes; and a plurality of first contact elements fixedly held in said first contact holes, each of said first contact elements having a terminal portion to be connected to corresponding ones of said terminal of said electrical device when said first connector unit is mounted onto said electrical device; and wherein said second connector unit comprises:

a plurality of second contact elements of elastic metal to be brought into contact with corresponding ones of said first contact elements of said first electrical connector unit, said second contact elements having a plurality of contact portions to be connected with corresponding ones of said exposed portions of said conductor lines;

a second insulator body to be removably and mechanically connected to said first insulator body, said second insulator body having a plurality of contact rooms in which said second contact elements are fixedly accommodated, respectively, said second insulator body further having a hole continuing to said contact rooms, in which hole said contact portions project;

a slider of insulator material having a receiving surface for receiving said flat wiring member and engaging means formed on said receiving surface for engaging with said projection means to prevent said flat wiring member from moving in a direction opposite to said end portion when said flat wiring member is received on said receiving surface, said slider being slidable into said hole together with said flat wiring member whereby said exposed portions come into contact with said contact portions, respectively; and locking means for locking said slider in said hole when said slider is inserted into said hole together with said flat wiring member being received on said receiving surface while said projection means engages said engaging means, whereby said flat wiring member and said slider being prevented from being removed out of said hole in said second insulator body.

8. An electrical connector device as claimed in claim 7, wherein said locking means comprises said slider having at least one engaging recess in a surface opposite to said receiving surface, and at least one engaging projection disposed in said hole for snapping into said engaging recess when said slider is inserted into said hole together with said flat wiring member.

9. An electrical connector device as claimed in claim 8, wherein said at least one engaging projection extends from at least one of said second contact element into said hole.

10. An electrical connector device as claimed in claim 7, said flat wiring member being a flat cable and said electrical device being a printed circuit board, wherein said first connector unit is to be mounted on said printed circuit board, and said second connector unit is fixedly connected to one end of said flat cable and removably connected to said first connector unit mounted on said printed circuit board.

11. An electrical connector for use in fixed connection with a flat wiring member, said flat wiring member comprising a plurality of conductor patterns spaced from each other in a flat insulator sheet of first and second insulator layers laminated together and holding said conductor patterns therebetween, said first insulator layer being short of an end at an end portion of said second insulator layer to provide exposed portions of said conductor patterns which portions are exposed from said first insulator layer, and projection means projecting from said flat insulator sheet at said end portion, said electrical connector comprising:

an insulator having a plurality of contact rooms and an insert cavity continuing to said contact rooms;

a plurality of contacts fixedly held in said contact rooms in said insulator; and a slide insulator to be inserted into said insert cavity in said insulator for bringing said conductor patterns of said flat wiring member into contact with said contacts within said insulator;

each of said contacts comprising a holding portion fixed to a room wall of each of said contact rooms, a contacting arm extending from said holding portion within said contact room along said insert cavity toward an open end of said insert cavity and having a contacting portion at an extending end of said contacting arm, said contacting portion projecting into said insert cavity, an engaging arm extending from said holding portion within said contact room along said insert cavity in parallel to said contacting arm and having an engaging portion at an extending end of said engaging arm, said engaging portion extending into said insert cavity, said contacting portion and said engaging portion having a predetermined space left therebetween; and said slide insulator having a slider insert portion to be inserted between said contacting portion and said engaging portion, said slider insert portion being provided with a receiving surface for receiving and carrying said flat wiring member thereon to bring each of said exposed portions of said conductor patterns into contact with said contacting portion of each one of said contacts when said slider insert portion is inserted together with said flat wiring member between said contacting portion and said engaging portion within said insert cavity in an inserting direction through said open end thereof, and said slider insert portion having first engaging means for engaging with said projection means of said flat wiring member in a removing direction opposite to said inserting direction, and second engaging means to be engaged with said engaging portion in said removing direction, whereby said flat wiring member and said slide insulator are prevented from removal from said insulator once inserted into said insert cavity.

12. An electrical connector as claimed in claim 11, said first engaging means comprising an engaging step portion formed in said receiving surface, and said projection means comprising a reinforcing means for engaging with said engaging step portion.

13. An electrical connector as claimed in claim 11, and first engaging means comprising an engaging protrusion formed on said receiving surface, said projection means having a step portion for engaging with said engaging protrusion.

14. An electrical connector as claimed in claim 11, said second engaging means having an engaging recess formed in the side opposite to said receiving surface.

15. An electrical connector as claimed in claim 14, said engaging portion having a contact-side engaging protrusion to be engaged with said engaging recess.

16. An electrical connector as claimed in claim 11, said flat wiring member having a grounding conductive pattern on a back side of said second insulator at said end, said insulator having an outer surface covered with a conductive base shell member, said slide insulator having an outer surface, including said receiving surface, covered with a slide shell member, said slide shell member being for contact with said grounding conductive pattern of said flat wiring member and with said base shell member.

17. An electrical connector as claimed in claim 11, said insulator having a pair of block portions formed at opposite sides of said insulator, each of said block portions having a base-side engaging groove extending from the bottom of said block portion in said inserting direction, said slide insulator having a pair of engaging plates to be fitted in said base-side engaging grooves in said inserting direction, each of said base-side engaging grooves having an internal wall provided with a first guide groove extending from the open end of said insert cavity in said inserting direction, a second guide groove continuously extending from said first guide groove in said inserting direction, and a first projecting portion formed between said first and said second guide grooves, each of said engaging plates having an outer surface provided with a second projecting portion which, when said slide insulator is inserted into said insert cavity, passes through said first guide groove, over said first projecting portion, and into said second guide groove to be engaged with said second guide groove in said releasing direction and to rotatably hold said slide insulator.

18. An electrical connector as claimed in claim 11, for use in mechanical and electrical connection of said flat wiring member with a mating electrical connector having a plurality of mating contacts in a mating insulator, wherein said insulator has a fitting portion to be fitted with said mating insulator of said mating connector, and said each of contacts having a contact portion extending from said holding portion into said fitting portion to be brought into contact with a corresponding one of said mating contacts when said fitting portion is fitted with said mating insulator.

19. An electrical connector as claimed in claim 11, wherein said flat wiring member is a flat cable.

20. An electrical apparatus including an electrical printed circuit board, a first electrical connector unit mounted on and electrically connected to said printed circuit board, a flat cable, and a second electrical connector unit mating with said first electrical connector for removably connecting said flat cable to said first electrical connector, wherein said flat cable comprises:

a plurality of strip-like conductor lines spaced from each other;

an insulator element of first and second insulator sheets laminated together and holding said conductor lines therebetween, said first insulator sheet being short of an end at an end portion of said second insulator sheet to provide exposed portions of said conductor lines which portions are exposed from said first insulator sheet; and projection means projecting from said insulator element at said end portion;

wherein said first connector unit comprises:

a first insulator body having a plurality of first contact holes; and a plurality of first contact elements fixedly held in said first contact holes, each of said first contact elements having a terminal portion to be connected to corresponding ones of terminals of said printed circuit board when said first connector unit is mounted onto said printed circuit board; and wherein said second connector unit comprises:

a plurality of second contact elements of elastic metal to be brought into contact with corresponding ones of said first contact elements of said first electrical connector unit, said second contact elements having a plurality of contact portions to be connected with corresponding ones of said exposed portions of said conductor lines;

a second insulator body to be removably and mechanically connected to said first insulator body, said second insulator body having a plurality of contact rooms in which said second contact elements are fixedly accommodated, respectively, said second insulator body further having a hole continuing to said contact rooms, in which hole said contact portions project;

a slider of insulator material having a receiving surface for receiving said flat cable and engaging means formed on said receiving surface for engaging with said projection means to prevent said flat cable from moving in a direction opposite to said end portion when said flat cable is received on said receiving surface, said slider being slidable into said hole together with said flat cable whereby said exposed portions come into contact with said contact portions, respectively, and locking means for locking said slider in said hole when said slider is inserted into said hole together with said flat cable being received on said receiving surface while said projection means engages said engaging means, whereby said flat cable and said slider are prevented from being removed out of said hole in said second insulator body.

21. An electric apparatus as claimed in claim 20, wherein said first and said second connector units have releasable connector locking means for locking said first and said second connector units in their mating condition, said releasable locking means being easily releasable from its locking condition.

* * * * *